US011215364B2

(12) United States Patent
Miyamoto et al.

(10) Patent No.: US 11,215,364 B2
(45) Date of Patent: Jan. 4, 2022

(54) COMBUSTOR, GAS TURBINE

(71) Applicant: Mitsubishi Hitachi Power Systems, Ltd., Kanagawa (JP)

(72) Inventors: Kenji Miyamoto, Tokyo (JP); Satoshi Takiguchi, Tokyo (JP); Koichi Nishida, Yokohama (JP); Yoshitaka Hirata, Yokohama (JP); Shohei Numata, Yokohama (JP); Keita Yunoki, Yokohama (JP); Yasuhiro Akiyama, Yokohama (JP); Tomoki Uruno, Yokohama (JP)

(73) Assignee: MITSUBISHI POWER, LTD., Kanagawa (JP)

( * ) Notice: Subject to any disclaimer, the term of this patent is extended or adjusted under 35 U.S.C. 154(b) by 74 days.

(21) Appl. No.: 16/079,865

(22) PCT Filed: Feb. 27, 2017

(86) PCT No.: PCT/JP2017/007375
§ 371 (c)(1),
(2) Date: Aug. 24, 2018

(87) PCT Pub. No.: WO2017/150419
PCT Pub. Date: Sep. 8, 2017

(65) Prior Publication Data

US 2019/0056111 A1 Feb. 21, 2019

(30) Foreign Application Priority Data

Feb. 29, 2016 (JP) ..... JP2016-036997

(51) Int. Cl.

| | |
|---|---|
| ***F23R 3/10*** | (2006.01) |
| ***F23R 3/16*** | (2006.01) |
| ***F23R 3/42*** | (2006.01) |
| ***F23R 3/28*** | (2006.01) |

(Continued)

(52) U.S. Cl.
CPC ..... *F23R 3/10* (2013.01); *F23R 3/002* (2013.01); *F23R 3/16* (2013.01); *F23R 3/283* (2013.01);

(Continued)

(58) Field of Classification Search
CPC .. F23R 3/286; F23R 3/343; F23R 3/10; F23R 3/16; F23R 3/002; F23R 3/283; F23R 3/42
See application file for complete search history.

(56) References Cited

U.S. PATENT DOCUMENTS

| | | | |
|---|---|---|---|
| 6,634,175 | B1 | 10/2003 | Kawata et al. |
| 2007/0199325 | A1 | 8/2007 | Tanimura et al. |

(Continued)

FOREIGN PATENT DOCUMENTS

| | | |
|---|---|---|
| CN | 101050867 | 10/2007 |
| EP | 0 128 541 | 12/1984 |

(Continued)

OTHER PUBLICATIONS

International Search Report dated May 9, 2017 in International (PCT) Application No. PCT/JP2017/007375, with English-language translation.

(Continued)

*Primary Examiner* — Katheryn A Malatek
(74) *Attorney, Agent, or Firm* — Wenderoth, Lind & Ponack, L.L.P.

(57) ABSTRACT

A combustor includes: a first cylindrical body which is configured to hold a fuel nozzle extending in an axial line direction and through which air flows toward a downstream side thereof; a second cylindrical body that is connected to a downstream side of the first cylindrical body; and an outer shell that has an inner peripheral surface configured to define an air introduction channel through which air is introduced (Continued)

such that the air reverses course at an upstream end of the first cylindrical body and flows toward the downstream side together with an outer peripheral surface of the first cylindrical body. The inner peripheral surface has an outside narrowing surface that is formed to extend inward in a radial direction toward the upstream end of the first cylindrical body.

6 Claims, 3 Drawing Sheets

(51) Int. Cl.
*F23R 3/00* (2006.01)
*F23R 3/44* (2006.01)

(52) U.S. Cl.
CPC ..... *F23R 3/286* (2013.01); *F23R 3/42* (2013.01); *F23D 2900/14004* (2013.01); *F23R 3/44* (2013.01)

(56) References Cited

U.S. PATENT DOCUMENTS

| | | | |
|---|---|---|---|
| 2007/0199326 | A1 | 8/2007 | Tanimura et al. |
| 2012/0045725 | A1 | 2/2012 | Takiguchi et al. |
| 2012/0125006 | A1 | 5/2012 | Saito et al. |
| 2014/0090390 | A1 | 4/2014 | Stuttaford et al. |
| 2014/0260300 | A1 | 9/2014 | Chila et al. |
| 2015/0075172 | A1 | 3/2015 | Stuttaford et al. |
| 2016/0069566 | A1 | 3/2016 | Numata et al. |

FOREIGN PATENT DOCUMENTS

| | | |
|---|---|---|
| JP | 59-229114 | 12/1984 |
| JP | 2000-346361 | 12/2000 |
| JP | 2001-289441 | 10/2001 |
| JP | 2007-23247 | 9/2007 |
| JP | 2007-232350 | 9/2007 |
| JP | 2014-173836 | 9/2014 |
| JP | 2014-178088 | 9/2014 |
| JP | 2016-56961 | 4/2016 |
| KR | 10-2015-0065820 | 6/2015 |
| WO | 00/75573 | 12/2000 |
| WO | 2011/018853 | 2/2011 |

OTHER PUBLICATIONS

Written Opinion of the International Searching Authority dated May 9, 2017 in International (PCT) Application No. PCT/JP2017/007375, with English-language translation.

COMBUSTOR, GAS TURBINE

TECHNICAL FIELD

The present invention relates to a combustor and a gas turbine.

Priority is claimed on Japanese Patent Application No. 2016-036997, filed Feb. 29, 2016, the content of which is incorporated herein by reference.

BACKGROUND ART

Generally, gas turbines include compressors which generate high pressure air, combustors which mix the high pressure air with fuel, burn the mixed gas, and thus generate high temperature and high pressure combustion gases, and turbines which are rotatably driven by the combustion gases.

As combustors, combustors according to various aspects have been proposed and put into practical use so far. As one example thereof, the combustor described in Patent Document 1 is known. The combustor described in Patent Document 1 includes a cylinder (support structure) through which a combustion gas flows, a mixing pipe provided on an upstream side of the cylinder, a fuel injector, and a tapered annular wall which guides high pressure air in a casing to the mixing pipe. When the tapered annular wall is provided on an outer peripheral side of the cylinder, the tapered annular wall forms an internal flow path through which high pressure air flows together with the outer peripheral surface of the cylinder.

Thus, a fuel supplied from the fuel injector and the high pressure air flowing through the internal flow path are mixed in the mixing pipe and then a combustion gas is generated through combustion in the cylinder.

CITATION LIST

Patent Literature

[Patent Document 1]

Japanese Unexamined Patent Application, First Publication No. 2014-173836

SUMMARY OF INVENTION

Technical Problem

Incidentally, first, the high pressure air in the casing is guided from a downstream side (a downstream side in a direction in which the combustion gas flows) toward an upstream side in the internal flow path formed by the tapered annular wall and the cylinder. Subsequently, the high pressure air reverses the flow direction thereof by 180° along an inner peripheral surface of the tapered annular wall and is introduced into the mixing pipe.

As described above, in the combustor described in Patent Document 1, a flow velocity distribution of high pressure air in an internal flow path is likely to become non-uniform because the reversal of a flow of the high pressure air is involved. When a flow velocity distribution of the high pressure air is not uniform, the flow imbalance also occurs in the cylinder on the downstream side, and as a result, the amount of NOx generated increases in some cases.

The present invention provides a combustor in which the amount of NOx generated is reduced by optimizing a flow velocity distribution of high pressure air.

Solution to Problem

According to a first aspect of the present invention, a combustor includes: a first cylindrical body which is configured to hold a fuel nozzle extending in an axial line direction and through which air flows toward a downstream side thereof; a second cylindrical body which is connected to the downstream side of the first cylindrical body; and an outer shell which has an inner peripheral surface configured to define an air introduction channel through which air is introduced such that the air reverses course at an upstream end of the first cylindrical body toward the downstream side together with an outer peripheral surface of the first cylindrical body, wherein the inner peripheral surface has an outside narrowing surface which is formed to extend inward in a radial direction toward the upstream end of the first cylindrical body.

According to this constitution, since the outside narrowing surface is formed on the inner peripheral surface in the outer shell, it is possible to uniformize a flow velocity distribution of air flowing along the outside narrowing surface in the air introduction channel. Particularly, since the outside narrowing surface extends inward in the radial direction toward an end of the first cylindrical body on the upstream side, when the air reverses course at the upstream end of the first cylindrical body, it is possible to increase a flow velocity of the air on an outer peripheral side thereof compared with a flow velocity of an inner peripheral side thereof. Thus, it is possible to uniformize the flow velocity distribution of the air at an outlet side of the air introduction channel.

According to a second aspect of the present invention, in the combustor according the first aspect, an inside narrowing surface extending outward in the radial direction toward the upstream end side of the first cylindrical body may be formed on the outer peripheral surface and formed in a portion which faces the outside narrowing surface from the radial direction.

According to this constitution, since the inside narrowing surface is formed on the outer peripheral surface of the first cylindrical body and is formed in the portion faces the outside narrowing surface, when air reverses course at the upstream end of the first cylindrical body, it is possible to optimize flow velocities of the air on the outer peripheral side as well as on the inner peripheral side of the upstream end.

According to a third aspect of the present invention, in the combustor according the second aspect, when an angle formed by the axial line and the outside narrowing surface in a cross-sectional view including the axial line is defined as a and an angle formed by the axial line and the inside narrowing surface is defined as $\beta$, a relationship of $\alpha<\beta$ may be satisfied.

According to this constitution, the angle $\alpha$ formed by the axial line and the outside narrowing surface on the inner peripheral surface of the outer shell is smaller than the angle $\beta$ formed by the axial line and the inside narrowing surface on the outer peripheral surface of the first cylindrical body. Thus, air flowing along the outside narrowing surface has a directional component toward the upstream side larger than that of air flowing along the inside narrowing surface. In other words, when air reverses course at the upstream end of the first cylindrical body, it is possible to increase a flow velocity of air on the outer peripheral side thereof compared with a flow velocity of air on the inner peripheral side thereof.

According to a fourth aspect of the present invention, in the combustor according to the second or third aspect, an end portion of the outside narrowing surface on the upstream side may be located closer to an end portion of the inside narrowing surface on the upstream side.

According to this constitution, since the end portion of the outside narrowing surface on the upstream side is located closer to the upstream side than the end portion of the inside narrowing surface on the upstream side, a flow of the air flowing along the outside narrowing surface more easily reaches the upstream side than a flow of the air flowing along the inside narrowing surface. Since the air guided through the outside narrowing surface contains a large amount of directional components toward an inner side of the central axial line in the radial direction, it is possible to more smoothly reverse the course of the air at the upstream end of the first cylindrical body.

According to a fifth aspect of the present invention, a gas turbine includes: a compressor which is configured to generate compressed air; the combustor according to any one of the first to fourth aspects; and a turbine which is rotatably driven by a combustion gas generated by the combustor.

According to the constitution, it is possible to provide a gas turbine including a combustor in which the amount of NOx generated is reduced.

Advantageous Effects of Invention

According to the above-described combustor, it is possible to reduce the amount of NOx generated by optimizing a flow velocity distribution of high pressure air.

DESCRIPTION OF EMBODIMENTS

First Embodiment

Figure 1:
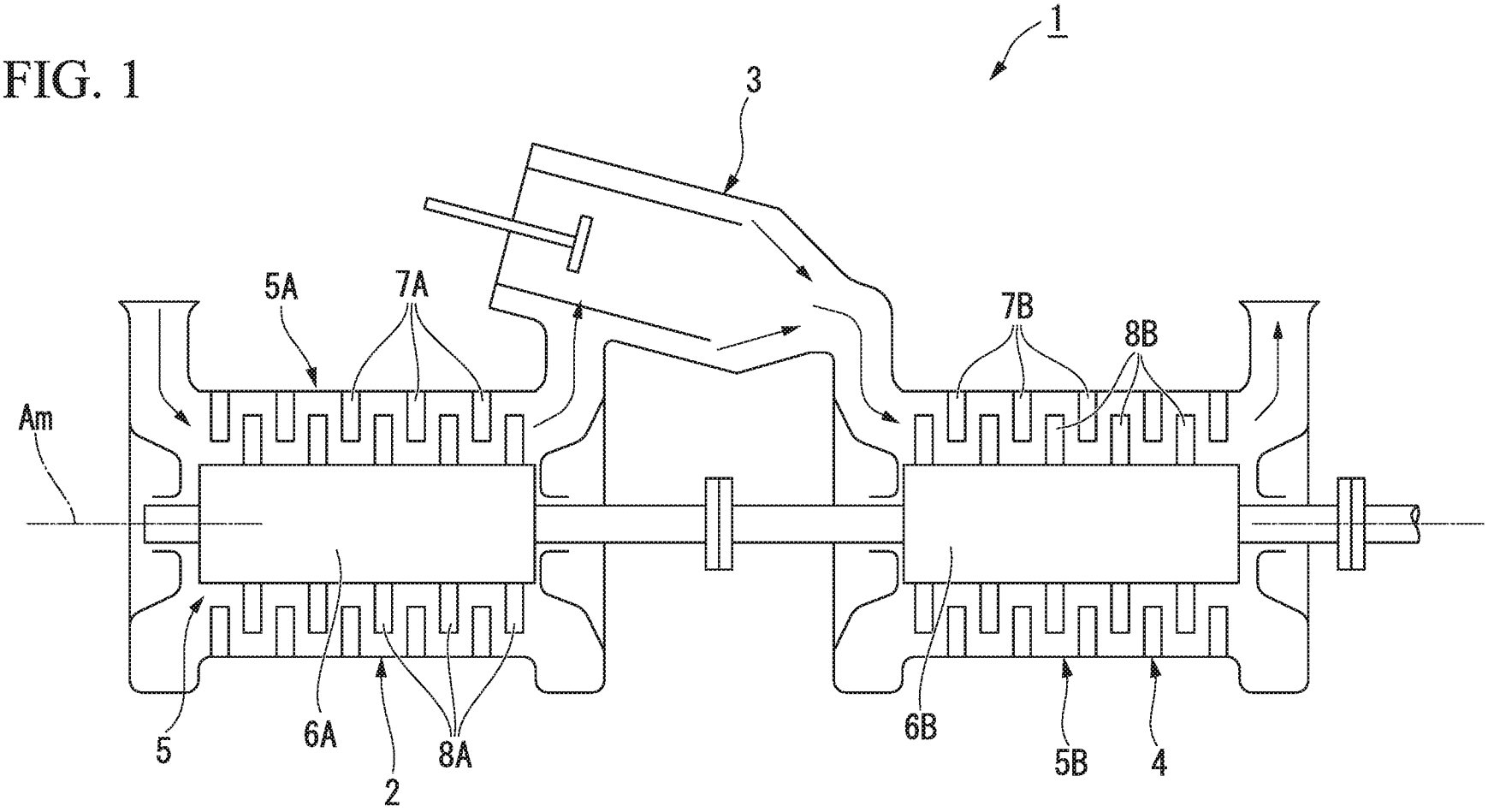
FIG. 1 is a schematic diagram showing a constitution of a gas turbine according to a first embodiment of the present invention.

A first embodiment of the present invention will be described with reference to FIGS. 1 to 3. As shown in FIG. 1, a gas turbine 1 according to this embodiment includes a compressor 2 which compresses the outside air to generate compressed air, a combustor 3 which mixes the compressed air with a fuel, burns the mixture, and generates a high temperature and high pressure combustion gas, and a turbine 4 which is rotatably driven by the combustion gas.

The compressor 2 includes a compressor casing 5A and a compressor rotor 6A which rotates about a main axial line Am in the compressor casing 5A. A plurality of compressor vanes 7A arranged at intervals in a peripheral direction of the main axial line Am are attached on an inner peripheral surface of the compressor casing 5A. A plurality of compressor blades 8A are attached on an outer peripheral surface of the compressor rotor 6A. The plurality of compressor vanes 7A and compressor blades 8A are alternately arranged in the main axial line Am direction.

For example, a plurality of combustors 3 are attached at intervals in the peripheral direction of the main axial line Am. Compressed air generated by the compressor 2 is supplied to the plurality of the combustors 3. A high temperature and high pressure combustion gas is generated by mixing the compressed air with a fuel and burning the mixture in the combustors 3.

The turbine 4 includes a turbine casing 5B and a turbine rotor 6B which rotates about the main axial line Am in the turbine casing 5B. A plurality of turbine vanes 7B arranged at intervals in the peripheral direction of the main axial line Am are attached on an inner peripheral surface of the turbine casing 5B. A plurality of turbine blades 8B are attached on an outer peripheral surface of the turbine rotor 6B. The plurality of turbine vanes 7B and turbine blades 8B are alternately arranged in the main axial line Am direction.

One end side (first end) of the turbine rotor 6B is connected to, for example, a generator (not shown) which is configured to generate electricity with the rotation of the turbine rotor 6B. On the other hand, the other end side (second end) of the turbine rotor 6B is connected to the compressor rotor 6A in the main axial line Am direction. In other words, the turbine rotor 6B and the compressor rotor 6A are integrally formed rotatably about the main axial line Am.

A constitution of the combustor 3 will be described below with reference to FIGS. 2 and 3. FIG. 2 is a cross-sectional view of the combustor 3 viewed from a direction in which the combustor 3 intersects a central axial line Ac (axial line) of the combustor 3 itself. As shown in FIG. 2, the combustor 3 is inserted into the turbine casing 5B through a combustor insertion port 9 formed in the turbine casing 5B. To be more specific, the combustor 3 includes an outer shell 10 which guides compressed air in the turbine casing 5B into the combustor 3, a combustor Swirler Assembly 11 (first cylindrical body) which mixes the compressed air with a fuel, burns the mixture, and supplies a combustion gas, and a combustor liner 12 (second cylindrical body) which sends the combustion gas to the turbine blades 8B in the turbine rotor 6B. It should be noted that, in the following description, a side on which the combustor Swirler Assembly 11 is located is referred to as an upstream side (forward side) and a side on which the combustor liner 12 is located is referred to as a downstream side (aft side) in the central axial line Ac of the combustor 3.

The outer shell 10 is a substantially cylindrical member which supports a fuel nozzle 13 which will be described later and is attached to block the combustor insertion port 9 from the outside. The outer shell 10 according to this embodiment includes an outer shell main body 10A and a nozzle base 14. The outer shell main body 10A has a disk shape centered on the central axial line Ac. A fitting convex portion 15 which is fitted into an inner peripheral side of the combustor insertion port 9 is formed in a region on an outer peripheral side on a surface of the outer shell main body 10A on the downstream side. In addition, a support opening 16 which supports the nozzle base 14 is formed in a central region including a center point of the outer shell main body 10A. It should be noted that the outer shell 10 is referred to as, for example, a top hat or the like in some cases.

An outer peripheral surface of the fitting convex portion 15 has a diameter dimension which is the same as or slightly smaller than an inner peripheral surface of the combustor insertion port 9. Thus, the outer peripheral surface of the fitting convex portion 15 is fitted to the inner peripheral surface of the combustor insertion port 9 without any gap. An inner peripheral surface of the fitting convex portion 15 faces an outer peripheral surface 11S of the combustor Swirler Assembly 11 with a gap in the radial direction of the central axial line Ac. This gap is used as an air introduction channel C for introducing compressed air into the turbine casing 5B. To be more specific, an outside narrowing surface 17, a parallel surface 18, and a reversing surface 19 are sequentially formed above the inner peripheral surface of the fitting convex portion 15 from the downstream side toward the upstream end of the combustor Swirler Assembly 11.

Figure 3:
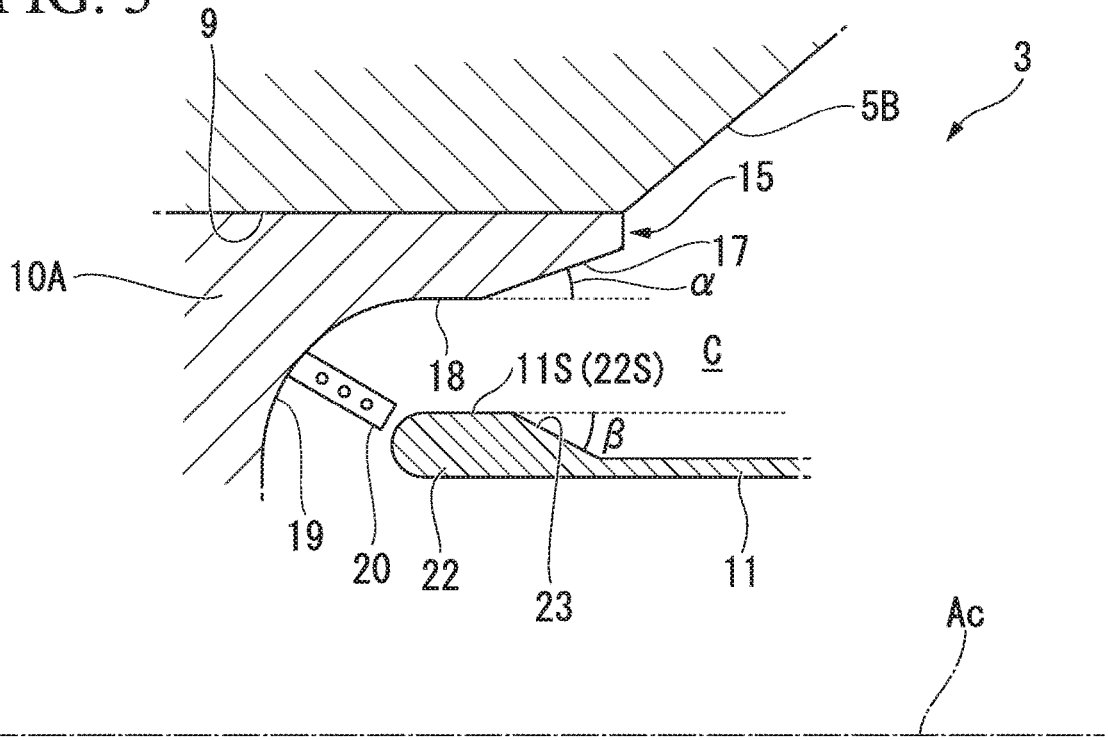
FIG. 3 is an enlarged cross-sectional view of a main part of the combustor according to the first embodiment of the present invention.

As shown in FIG. 3, the outside narrowing surface 17 extends to be inclined by an angle α with respect to the central axial line Ac in a cross-sectional view including the central axial line Ac. To be more specific, the outside narrowing surface 17 extends inward in the radial direction of the central axial line Ac from the downstream side toward the upstream side along the inner peripheral surface of the fitting convex portion 15.

In addition, an end portion of the outside narrowing surface 17 on the upstream side is connected to the parallel surface 18. The parallel surface 18 extends parallel to the central axial line Ac. An end portion of the parallel surface 18 on the upstream side is connected to the reversing surface 19.

The reversing surface 19 is a curved surface connected to the end portion of the parallel surface 18 on the upstream side. To be more specific, the reversing surface 19 is a quarter circular arc centered on the upstream end of the combustor Swirler Assembly 11 in a cross-sectional view including the central axial line Ac. The end portion of the reversing surface 19 on the upstream side (that is, the end portion of the central axial line Ac on an inner side in the radial direction) is connected to an inner peripheral surface of the support opening 16.

A top hat nozzle which injects a fuel into the air introduction channel C (hereinafter referred to as "a peg 20") is attached to the reversing surface 19. To be specific, the peg 20 has a bar shape in which the peg 20 extends from the inner peripheral surface in the reversing surface 19 toward the central axial line Ac in a direction of 45°. Although not shown in detail, the peg 20 is connected to a fuel supply source. This fuel is mixed with compressed air in the air introduction channel C.

Figure 2:
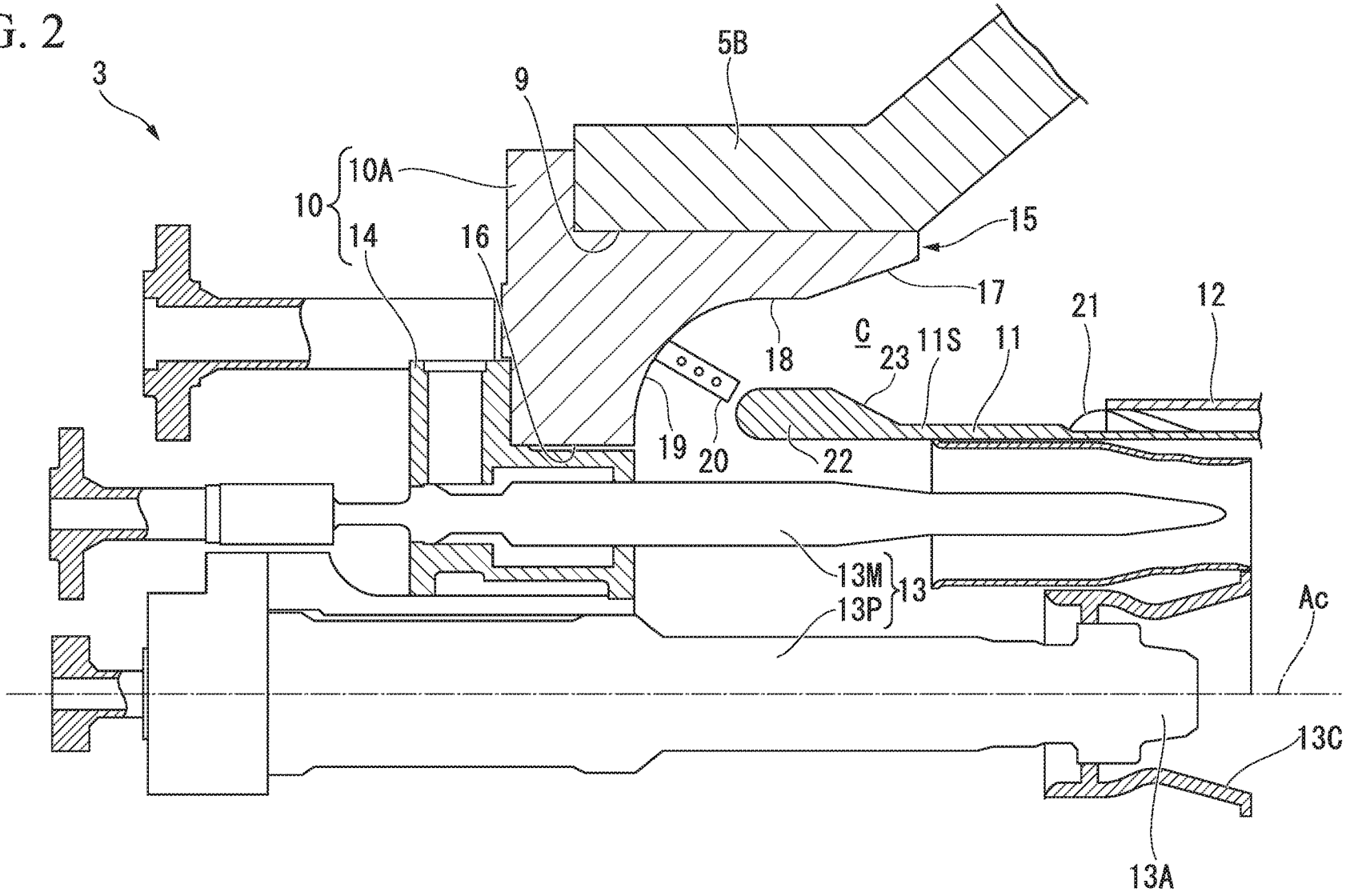
FIG. 2 is a cross-sectional view of a combustor according to the first embodiment of the present invention.

As shown in FIG. 2, the nozzle base 14 is a member which supports the fuel nozzle 13. In this embodiment, the fuel nozzle 13 includes nozzles of two types, i.e., a first nozzle 13P and a second nozzle 13M. To be more specific, as shown in FIG. 2, the nozzle base 14 has an annular shape in which the nozzle base 14 is supported by the support opening 16 in the outer shell main body 10A from the outer peripheral side. The first nozzle 13P is inserted into a region including a center point of the nozzle base 14.

The first nozzle 13P has a columnar shape in which the first nozzle 13P extends along the central axial line Ac and has a hollow inside from the upstream side thereof to the downstream side thereof. The fuel supply source is connected to the upstream side of the first nozzle 13P, and a fuel supplied from the upstream side thereof into the first nozzle 13P flows toward the downstream side thereof and then is injected from a first nozzle main body 13A provided at a distal end thereof on the downstream side into the combustor Swirler Assembly 11. A first cone 13C is attached to the outer peripheral side of the first nozzle main body 13A. The first cone 13C is a funnel-like member whose diameter gradually increases from the upstream side toward the downstream side of the central axial line Ac.

In addition, a plurality of second nozzles 13M are attached to a region in the nozzle base 14 on the outer peripheral side (that is, a region closer to the outer peripheral side than the first nozzle 13P) at intervals in a peripheral direction of the central axial line Ac. The second nozzles 13M extend parallel to each other along the central axial line Ac. A fuel supplied from the fuel supply source flows into the second nozzle 13M as in the first nozzle 13P. A fuel supplied from the upstream side is supplied into the combustor Swirler Assembly 11 through an injection port (not shown) formed on the downstream side.

The combustor Swirler Assembly 11 has a cylindrical shape in which the combustor Swirler Assembly 11 extends along the central axial line Ac. The combustor liner 12 is connected to an end portion of the combustor Swirler Assembly 11 on the downstream side via a connecting member 21. The combustor Swirler Assembly 11 is inserted into an inner peripheral side of the combustor liner 12 because the combustor Swirler Assembly 11 has an outer diameter smaller than an inner diameter of the combustor liner 12. The connecting member 21 is constituted of an annular elastic member extending in the peripheral direction of the central axial line Ac. All distal end portions of the fuel nozzle 13 (the first nozzle 13P and the second nozzle 13M) are held inside the combustor Swirler Assembly 11 in a state in which the nozzle base 14 is attached to the combustor insertion port 9.

In addition, as shown in FIG. 3, a swollen portion 22 that swells outward in the radial direction is provided on a portion including the end portion of the combustor Swirler Assembly 11 on the upstream side. The thickness dimension of the swollen portion 22 (a dimension of the central axial line Ac in the radial direction) is set larger than a thickness dimension of the combustor Swirler Assembly 11 in a portion other than the swollen portion 22. An end surface of the swollen portion 22 on the upstream side has a semicircular arc-shaped cross section in a cross-sectional view including the central axial line Ac.

An inside narrowing surface 23 is formed on the outer peripheral surface 11S of the combustor Swirler Assembly 11 (above an outer peripheral surface 22S of the swollen portion 22) and is formed in a portion which faces the outside narrowing surface 17 from the radial direction. The inside narrowing surface 23 extends to be inclined by an angle β with respect to the central axial line Ac in a cross-sectional view including the central axial line Ac. To be more specific, the inside narrowing surface 23 extends outward in the radial direction from the downstream side toward the upstream side along the outer peripheral surface 11S of the combustor Swirler Assembly 11.

In addition, in this embodiment, a value of the angle α formed by the outside narrowing surface 17 and the central axial line Ac (the parallel surface 18) and a value of the angle β formed by the inside narrowing surface 23 and the outer peripheral surface 11S in the combustor Swirler Assembly 11 satisfy a relationship of $\alpha<\beta$.

In addition, as shown in FIG. 3, an end portion of the outside narrowing surface 17 on the upstream side is located closer to the upstream side than an end portion of the inside narrowing surface 23 on the upstream side.

As described above, the air introduction channel C is formed by an inner peripheral surface in the outer shell 10 and the outer peripheral surface 11S in the combustor Swirler Assembly 11. A radial dimension of a portion including an end portion of the air introduction channel C on the downstream side (that is, a flow path formed by the outside narrowing surface 17 and the inside narrowing surface 23) gradually decreases from the downstream side toward the upstream side.

An operation of the gas turbine 1 according to this embodiment will be described below with reference to FIG. 1.

When the gas turbine 1 is operated, first, the compressor 2 is driven using an external power source. When the compressor 2 is driven, the external air enters the compressor 2, is gradually compressed while flowing between the compressor blades 8A and the compressor vanes 7A, and becomes high pressure compressed air.

The compressed air generated in the compressor 2 enters the combustor 3 via the turbine casing 5B. Although this will be described in detail later, the combustor 3 mixes a fuel supplied through the fuel nozzle 13 and the compressed air and then burns the mixture and generates a high temperature and high pressure combustion gas.

The combustion gas generated in the combustor 3 is supplied to the subsequent turbine 4. In the turbine 4, the combustion gas collides with the turbine blades 8B, thereby exerting rotational power on the turbine rotor 6B. Thus, the turbine rotor 6B rotates. Since the turbine rotor 6B is integrally connected to the compressor rotor 6A as described above, the compressor rotor 6A is also rotatably driven with the rotation of the turbine rotor 6B. In other words, in a normal operation state, the generation of the compressed air using the compressor 2 and the rotation of the turbine 4 form a continuous cycle.

A behavior of compressed air in the combustor 3 will be described below with reference to FIGS. 2 and 3. As shown in FIG. 2, compressed air generated in the compressor 2 first flows into the turbine casing 5B. Here, since the internal pressure in the combustor 3 is relatively lower than that in the turbine casing 5B, the compressed air naturally enters the combustor 3.

To be more specific, the compressed air in the turbine casing 5B flows into the combustor Swirler Assembly 11 through the air introduction channel C. In the combustor Swirler Assembly 11, the compressed air flows from the upstream side to the downstream side to surround the second nozzle 13M from the outside. Here, a fuel is injected from an end portion of the second nozzle 13M on the downstream side as described above. Thus, in a region of the second nozzle 13M on the downstream side, a premixed gas obtained by mixing the fuel and the compressed air is generated.

Only a fuel is injected from a distal end of the first nozzle 13P. When the fuel is ignited by an ignition apparatus (not shown), a pyrolytic flame due to diffusion combustion is formed. When the pyrolytic flame propagates to the premixed gas, a premixed flame is formed and the combustion gas is generated on the downstream side of the second nozzle 13M.

Incidentally, as shown in FIG. 3, the compressed air is guided into the combustor 3 through the air introduction channel C defined by the outer shell 10 and the combustor Swirler Assembly 11. As described above, an end portion of the air introduction channel C opens toward the downstream side. The compressed air flows from inside the turbine casing 5B into the air introduction channel C through the opening and then flows from the upstream side toward the downstream side inside the combustor Swirler Assembly 11 by changing the direction thereof through 180° reversal using the reversing surface 19.

Here, since the above-described reversal of the flow direction is involved in the air introduction channel C, flow velocities of the compressed air on an outer peripheral side of the reversing surface 19 (that is, a side closer to the reversing surface 19 than the swollen portion 22) and an inner peripheral side thereof (the swollen portion 22 side) differ. The imbalance due to such a flow velocity distribution is likely to cause a deviation in an air flow rate on the downstream side of the air introduction channel C, that is, the upstream side of the combustor Swirler Assembly 11. When such a deviation of the air flow rate occurs, a concentration distribution of a combustion gas is also likely to deviate. Thus, the amount of NOx generated is also likely to be larger than a prescribed amount.

However, in the combustor 3 according to this embodiment, the outside narrowing surface 17 is formed on the inner peripheral surface in the outer shell 10. Thus, it is possible to uniformize a flow velocity distribution of air flowing along the outside narrowing surface 17 in the air introduction channel C. Particularly, the outside narrowing surface 17 extends inward in the radial direction toward an end of the combustor Swirler Assembly 11 on the upstream side. Thus, when air reverses course at the upstream end of the combustor Swirler Assembly 11, it is possible to increase a flow velocity of the air on an outer peripheral side thereof compared with a flow velocity of an inner peripheral side thereof. Therefore, it is possible to uniformize a flow velocity distribution of the air on an outlet side of the air introduction channel C.

In addition, according to the above-described constitution, the inside narrowing surface 23 is formed on the outer peripheral surface of the combustor Swirler Assembly 11 formed in a portion which faces the outside narrowing surface 17. Thus, when air reverses course at the upstream end of the combustor Swirler Assembly 11, it is possible to optimize flow velocities of the air on the outer peripheral side as well as on the inner peripheral side of the upstream end.

In addition, according to the above-described constitution, the angle $\alpha$ formed by the central axial line Ac and the outside narrowing surface 17 on the inner peripheral surface of the outer shell 10 is smaller than the angle $\beta$ formed by the central axial line Ac and the inside narrowing surface 23 on the outer peripheral surface of the combustor Swirler Assembly 11. Thus, air flowing along the outside narrowing surface 17 has a directional component toward the upstream side larger than that of air flowing along the inside narrowing surface 23. Therefore, when air reverses course at the upstream end of the combustor Swirler Assembly 11, it is possible to increase a flow velocity of air on the outer peripheral side thereof compared with a flow velocity of air on the inner peripheral side thereof.

Also, according to the above-described constitution, the end portion of the outside narrowing surface 17 on the upstream side is located closer to the upstream side than the end portion of the inside narrowing surface 23 on the upstream side. Thus, a flow of the air flowing along the outside narrowing surface 17 more easily reaches the upstream side than a flow of the air flowing along the inside narrowing surface 23. The air guided through the outside narrowing surface 17 contains a large amount of directional components from an outer side toward an inner side of the central axial line Ac in the radial direction. Thus, it is possible to more smoothly reverse the air at the upstream end of the combustor Swirler Assembly 11. As described above, in the combustor 3 according to this embodiment, a concentration distribution of a combustion gas is optimized by optimizing a flow velocity distribution of compressed air. Thus, it is possible to reduce the amount of NOx generated.

Second Embodiment

Figure 4:
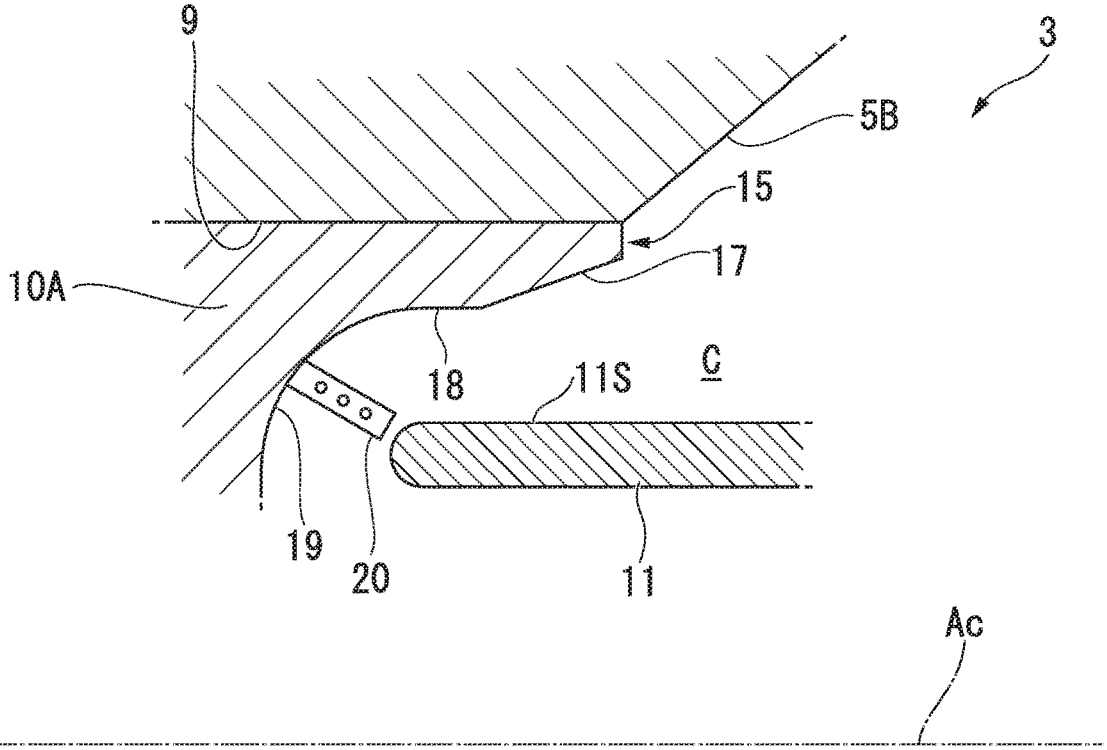
FIG. 4 is an enlarged cross-sectional view of a main part of a combustor according to a second embodiment of the present invention.

A second embodiment according to the present invention will be described below with reference to FIG. 4. It should be noted that constitutions that are the same as those in the first embodiment will be denoted with the same reference numerals and detailed description thereof will be omitted. As shown in FIG. 4, this embodiment and the first embodiment differ in that a swollen portion 22 is not formed at an end portion of a combustor Swirler Assembly 11 on the upstream side in this embodiment. In other words, in this embodiment, an outer peripheral surface 11S of the combustor Swirler Assembly 11 has the same outer diameter dimension from the upstream side to the downstream side. In addition, an end surface of the combustor Swirler Assembly 11 on the upstream side has a semicircular arc-shaped cross-sectional shape as in the first embodiment.

With the above-described constitution, it is possible to obtain actions and effects that are the same as in the first embodiment. Particularly, since an inside narrowing surface 23 is not formed, a flow directional component from an inside in the radial direction toward an outside in the radial direction is reduced. On the other hand, a component from the outside toward the inside in the radial direction (that is, a component along a reversing surface 19) in a flow guided along an outside narrowing surface 17 is increased. Thus, it is possible to more smoothly reverse compressed air. Therefore, it is possible to further optimize a flow velocity distribution of compressed air on an outlet side of an air introduction channel C.

Embodiments of the present invention have been described above with reference to the drawings. It is to be noted that various modifications can be adopted to the above-described constitution without departing from the gist of the present invention.

For example, in each of the above-described embodiments, an example in which a connection portion between the outside narrowing surface 17 and the parallel surface 18 and a connection portion between the inside narrowing surface 23 and the swollen portion 22 both have corner portions has been described. However, a constitution of the connection portions is not limited by the above-described embodiments and may be a curved surface in which the connection portions are continuous. To be specific, a constitution that is gently curved from the outside narrowing surface 17 toward the parallel surface 18 or from the inside narrowing surface 23 toward the swollen portion 22 may be provided. According to such a constitution, it is possible to further reduce a possibility of the occurrence of flow stagnation or peeling than in a case in which a corner portion is formed. Thus, it is possible to further optimize the flow velocity distribution of compressed air in the air introduction channel C.

In addition, in each of the above-described embodiments, an example in which the parallel surface 18 is formed between the outside narrowing surface 17 and the reversing surface 19 has been described. However, it is also possible to adopt a constitution in which the reversing surface 19 is directly connected to the end portion of the outside narrowing surface 17 on the upstream side. In other words, a constitution in which the parallel surface 18 is not formed on the inner peripheral surface of the outer shell 10 may be adopted. The above-described actions and effects can be similarly obtained with such a constitution.

INDUSTRIAL APPLICABILITY

According to the combustor, it is possible to reduce the amount of NOx generated by optimizing a flow velocity distribution of high pressure air.

REFERENCE SIGNS LIST

1 Gas turbine
2 Compressor
3 Combustor
4 Turbine
5A Compressor casing
5B Turbine casing
6A Compressor rotor
6B Turbine rotor
7A Compressor vane
7B Turbine vane
8A Compressor blade
8B Turbine blade
9 Combustor insertion port
10 Outer shell
10A Outer shell main body
11 Combustor Swirler Assembly (first cylindrical body)
11S Outer peripheral surface of combustor Swirler Assembly
12 Combustor liner (second cylindrical body)
13 Fuel nozzle
13A First nozzle main body
13C First cone
13M Second nozzle
13P First nozzle
14 Nozzle base
15 Fitting convex portion
16 Support opening
17 Outside narrowing surface
18 Parallel surface
19 Reversing surface
20 Peg
21 Connecting member
22 Swollen portion
22S Outer peripheral surface of swollen portion
23 Inside narrowing surface
Ac Central axial line
Am Main axial line
C Air introduction channel

What is claimed is:

1. A combustor, comprising:

a first cylindrical body which is configured to hold a fuel nozzle extending in a direction of an axial line and through which air flows toward an aft side thereof;

a second cylindrical body which is connected to the aft side of the first cylindrical body; and an outer shell which has an inner peripheral surface configured to define, together with an outer peripheral surface of the first cylindrical body, an air introduction channel through which the air is introduced such that the air reverses course at a forward end of the first cylindrical body toward the aft side, wherein the outer shell includes a fitting convex portion which is fitted to an inner peripheral side of a combustor insertion port provided in a turbine casing, wherein an inner peripheral surface of the fitting convex portion has an outside narrowing surface at an aft end of the outer shell which is formed to extend inward in a radial direction toward the forward end of the first cylindrical body, wherein an inner peripheral surface of the combustor insertion port has a constant diameter, and wherein the outer shell is in direct contact with the inner peripheral surface of the combustor insertion port from a forward end of the combustor insertion port to the aft end of the outer shell.

2. The combustor according to claim 1, wherein the first cylindrical body includes a swollen portion arranged at the forward end of the first cylindrical body, the swollen portion having a greater thickness than that of any other portion of the first cylindrical body, and wherein an inside narrowing surface is formed on the outer peripheral surface of the first cylindrical body, the inside narrowing surface sloping outward in the radial direction toward the forward end of the first cylindrical body and extending to a radially outer surface of the swollen portion, the inside narrowing surface being arranged so as to face the outside narrowing surface in the radial direction.

3. The combustor according to claim 2, wherein, when an angle formed by the axial line and the outside narrowing surface in a cross-sectional view including the axial line is defined as $\alpha$ and an angle formed by the axial line and the inside narrowing surface is defined as $\beta$, a relationship of $\alpha<\beta$ is satisfied.

4. The combustor according to claim 3, wherein a forward end portion of the outside narrowing surface is located farther forward than a forward end portion of the inside narrowing surface.

5. The combustor according to claim 2, wherein a forward end portion of the outside narrowing surface is located farther forward than a forward end portion of the inside narrowing surface.

6. A gas turbine, comprising:

a compressor which is configured to generate compressed air;

the combustor according to claim 1; and a turbine which is rotatably driven by a combustion gas generated by the combustor.

* * * * *